US011274905B2

(12) United States Patent
White et al.

(10) Patent No.: US 11,274,905 B2
(45) Date of Patent: Mar. 15, 2022

(54) BALLISTIC HELMET

(71) Applicant: Racal Acoustics Ltd., Harrow (GB)

(72) Inventors: Jackson White, Harrow (GB); Habib Hussein, Harrow (GB); Norman Davidson, Harrow (GB)

(73) Assignee: Racal Acoustics Ltd., Harrow (GB)

( * ) Notice: Subject to any disclaimer, the term of this patent is extended or adjusted under 35 U.S.C. 154(b) by 0 days.

(21) Appl. No.: 16/412,322

(22) Filed: May 14, 2019

(65) Prior Publication Data

US 2020/0080820 A1 Mar. 12, 2020

Related U.S. Application Data

(63) Continuation of application No. 15/119,109, filed as application No. PCT/GB2015/050487 on Feb. 19, 2015, now abandoned.

(30) Foreign Application Priority Data

Feb. 19, 2014 (GB) ..... 1402919

(51) Int. Cl.
*F41H 1/08* (2006.01)
*A42B 3/06* (2006.01)
(Continued)

(52) U.S. Cl.
CPC ..... *F41H 1/08* (2013.01); *A42B 3/0433* (2013.01); *A42B 3/063* (2013.01); *A42B 3/166* (2013.01);
(Continued)

(58) Field of Classification Search
CPC ... F41H 1/08; H04R 1/1008; H04R 2201/107; H04R 2460/07; H04R 1/10; A42B 3/303;
(Continued)

(56) References Cited

U.S. PATENT DOCUMENTS 4,166,978 A 9/1979 White et al.
6,198,206 B1 3/2001 Saarmaa et al.
(Continued)

FOREIGN PATENT DOCUMENTS

WO WO-2012122650 A1 * 9/2012 ..... F41H 1/08
WO 2015124937 A1 8/2015

OTHER PUBLICATIONS

International Searching Authority, International Search Report and Written Opinion, PCT Patent Application PCT/GB2015/050487, dated Jun. 29, 2015, 16 pages.
(Continued)

*Primary Examiner* — Md S Elahee
(74) *Attorney, Agent, or Firm* — Withrow & Terranova, PLLC

(57) ABSTRACT

A ballistic helmet comprising a ballistic shell, wherein within the thickness of the ballistic shell, or inside the ballistic shell, there is provided one or more circuit layers forming a circuit, which circuit comprises a power bus and a data bus, and wherein one or more power connections and one or more data connections are provided on the inside and/or on an edge of the ballistic shell for providing power and data to/from one or more electrical devices through the circuit.

20 Claims, 8 Drawing Sheets

(51) Int. Cl.

| | |
|---|---|
| ***A42B 3/16*** | (2006.01) |
| ***A42B 3/22*** | (2006.01) |
| ***A42B 3/32*** | (2006.01) |
| ***A42B 3/30*** | (2006.01) |
| ***A42B 3/04*** | (2006.01) |
| ***A42B 3/20*** | (2006.01) |
| ***A42B 3/28*** | (2006.01) |
| ***H04R 1/10*** | (2006.01) |

(52) U.S. Cl.

CPC ..... *A42B 3/205* (2013.01); *A42B 3/222* (2013.01); *A42B 3/225* (2013.01); *A42B 3/288* (2013.01); *A42B 3/30* (2013.01); *A42B 3/303* (2013.01); *A42B 3/326* (2013.01); *H04R 1/1008* (2013.01); *H04R 2201/107* (2013.01); *H04R 2460/07* (2013.01)

(58) Field of Classification Search

CPC ..... A42B 3/288; A42B 3/225; A42B 3/205; A42B 3/166; A42B 3/063; A42B 3/0433; A42B 3/30; A42B 3/326; A42B 3/222; A42B 3/28; A42B 3/22; A42B 3/20; A42B 3/16; A42B 3/06; A42B 3/04; A42B 3/32

USPC ..... 381/375, 376, 71.6; 702/58; 340/468; 2/422

See application file for complete search history.

(56) References Cited

U.S. PATENT DOCUMENTS

| | | | | |
|---|---|---|---|---|
| 9,516,910 | B2 * | 12/2016 | Szalkowski | F41H 1/08 |
| 2006/0277664 | A1 | 12/2006 | Akhtar et al. | |
| 2010/0142718 | A1 * | 6/2010 | Chin | G10K 11/178 381/71.6 |
| 2011/0035167 | A1 * | 2/2011 | Qing | G01M 5/00 702/58 |
| 2013/0086722 | A1 * | 4/2013 | Teetzel | A42B 3/30 2/2.5 |
| 2013/0306834 | A1 | 11/2013 | Tighe | |
| 2014/0020159 | A1 * | 1/2014 | Teetzel | A42B 3/04 2/422 |
| 2014/0104055 | A1 | 4/2014 | Boutte | |
| 2017/0052000 | A1 | 2/2017 | White et al. | |

OTHER PUBLICATIONS

European Patent Office, European Examination Report, EP Patent Application 15706279.5, dated Apr. 4, 2018, 6 pages.

Parisot, F. "Do you know plastronics?—Technos and Innovations," published May 8, 2012. <www.usinenouvelle.com/article/connaissez-vous-la-plastronique.N173853> translation, 6 pages.

Summons to Attend Oral Proceedings for European Patent Application No. 15706279.5, mailed Apr. 22, 2021, 7 pages.

* cited by examiner

BALLISTIC HELMET

CROSS REFERENCE TO RELATED APPLICATIONS

The present application is a continuation of U.S. patent application Ser. No. 15/119,109, filed Aug. 15, 2016, which is a 35 U.S.C. § 371 U.S. National Phase application of International Patent Application No. PCT/GB2015/050487, filed Feb. 19, 2015, which claims priority to Great Britain Patent Application No. 1402919.3, filed Feb. 19, 2014, all of which are incorporated herein by reference in their entireties.

TECHNICAL FIELD

The present disclosure relates to a ballistic helmet, in particular to a ballistic helmet that has one or more circuit layers integrated therein, which circuit layers may be used for the integration of electronics into the helmet to provide a communications capability.

BACKGROUND

Until now ballistic helmets and hearing protection/communication systems or other apparatus providing tactical capabilities have been treated separately and have been designed and manufactured as such. By designing and manufacturing these elements separately, both systems are generally compromised when they are brought together, with regards, for example, to the protection offered, weight, functionality and cost.

By way of example, FIGS. 1*a* and 1*b* show prior art ballistic helmets whilst FIGS. 2*a* and 2*b* show prior art hearing protection headsets for use, respectively, with the ballistic helmets of FIGS. 1*a* and 1*b*.

The ballistic helmet 101 of FIG. 1*a* is provided with cut out areas 102 for receiving a circum-aural hearing protection system, such as the hearing protection headset 201 of FIG. 2*a*, which comprises two earpieces 202, a neckband 203, a voice communications microphone 204 and a head strap (not shown), which attaches to mounting points 205 and is arranged to pass over the top of the ballistic helmet 101.

The ballistic helmet 105 of FIG. 1*b* is provided with protrusions 106 for receiving a hearing protection headset, such as the hearing protection headset 206 of FIG. 2*b*, which comprises two earpieces 207 that by virtue of wasted upper portions are shaped to fit under the protrusion 106 (with the non-wasted lower portions protruding below the level of the helmet), a neckband 208, a voice communications microphone 209 and a head strap 210, which fits over the ballistic helmet 105.

The helmet 101 in FIG. 1*a* loses ballistic protection in the cut out areas 102. The helmet 105 in FIG. 1*b* is made bulky by the inclusion of the protrusions 106. Both of the headsets 201, 206 are compromised by the requirements for a neck band 203, 208 and head strap 210, which complicate the design, increase the manufacturing cost and add weight.

There is a further problem that no provision is made in either helmet for the routing of wires, which will be required to carry power and data to the headsets (and any other apparatus providing tactical capabilities that may be attached to the helmets, such as night vision goggles, cameras, lights, etc), wherein such wiring can significantly impede movement and/or provide a snagging hazard.

In this regard, whilst prior art ballistic helmets may be provided with optional Picatinny rails 103 and connection points 104, as shown on the helmet 101 of FIG. 1*a*, which can be used to mount ancillary equipment to helmets or even the earpieces of a hearing protection system (which earpieces will be provided with appropriate connection means). Power and data may only be supplied to the individual equipment or earpieces by separate wires on the outside of the helmet.

Attempts have been made to address the issues of cable routing to external apparatus mounted on helmets. In US 2013/008672 a helmet system is provided in which a flexible circuit substrate is attached to the outside surface of a ballistic shell. The flexible circuit substrate is covered with an outer skin or shell. External brackets for attachment of external apparatus are provided which connect to the substrate through openings in the outer skin or shell. In US 2014/0020159 a helmet edge trim wiring harness is disclosed, which is arranged to be received over the unfinished edge of a ballistic shell, the edge trim comprises a circuit substrate provided therein. The edge trim supports a plurality of externally mounted apparatuses thereon that connect to the circuit substrate. Both arrangements, however, are formed in the same manner as the prior art helmet of FIG. 1*b* with protrusions 106 for receiving a hearing protection headset, rendering them bulky.

SUMMARY

The present invention arose in a bid to provide an improved ballistic helmet configured to allow the integration of additional systems, components or capabilities, including an audio communications capability, whilst maintaining a helmet with minimised profile and maximum ballistic protection.

According to the present invention in a first aspect, there is provided a ballistic helmet comprising a ballistic shell, wherein within the thickness of the ballistic shell, or inside the ballistic shell, there is provided one or more circuit layers forming a circuit, which circuit comprises a power bus and a data bus, and wherein one or more power connections and/or one or more data connections are provided on the inside and/or on an edge of the ballistic shell for providing power and data to/from one or more electrical devices through the circuit, wherein the ballistic helmet comprises integrated earpieces for the provision of an audio signal to the wearer of the helmet, and wherein at least one of the data connections and/or at least one of the power connections is provided adjacent each earpiece, thereby providing data and/or power connections for the earpieces to the circuit.

By the inclusion of circuit layers and data connectors, as defined, there may be provided a fully integrated ballistic helmet. In particular, hearing protection/communication systems may be integrated into the ballistic helmet without wiring for power or data impeding the movement of the wearer of the helmet or causing a snagging risk and without a significant increase in the bulk of the helmet by their inclusion. Moreover, power and data links are protected by the ballistic shell so that they are not vulnerable if the helmet is hit by a projectile.

Further, preferred, features are presented in the dependent claims.

BRIEF DESCRIPTION OF THE DRAWINGS

Non-limiting embodiments will now be described, by way of example only, with reference to the accompanying drawings, in which:

FIGS. 11*a* to 11*d* show exemplary arrangements of additional ballistic protection elements, wherein FIG. 11*a* shows a partial sectional view of a ballistic helmet that is provided with a retractable visor and FIGS. 11*b* to 11*d* show perspective views of ballistic helmets with alternative modular ballistic protection elements provided for protection of the wearer's face.

DETAILED DESCRIPTION

Figure 8A:
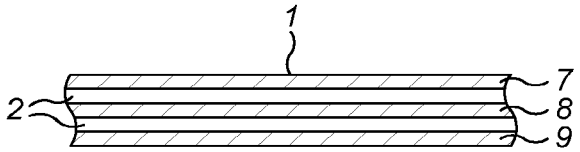
FIGS. 8*a* to 8*d* shows schematic sectional views through a ballistic shell for the construction of a ballistic helmet in accordance with any of the arrangements shown in FIGS. 3 to 7.
Figure 8B:
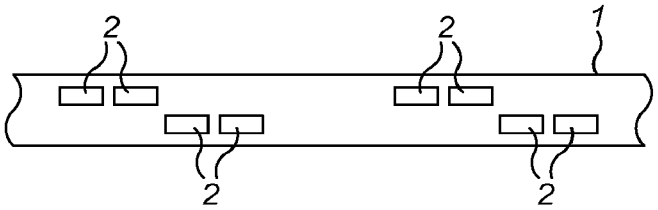
Figure 8C:
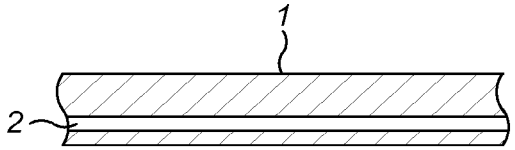
Figure 8D:
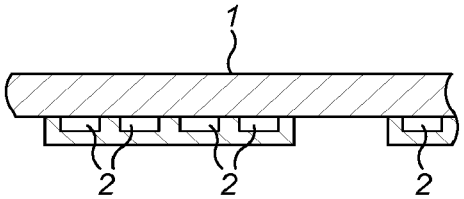

The present invention provides a ballistic helmet comprising a ballistic shell 1, wherein within the thickness of the ballistic shell (as seen in FIGS. 8*a* and 8*b*), or inside the ballistic shell (as seen in FIGS. 8*c* and 8*d*), there is provided one or more circuit layers 2 forming a circuit 10 (as shown, schematically, in FIG. 10), which circuit 10 comprises a power bus 3 and a data bus 4, and wherein one or more power connections 5 and/or one or more data connections 6 are provided on the inside and/or on an edge of the ballistic shell for providing power and data to/from one or more electrical devices through the circuit.

As discussed in detail below, by the provision of the data connections on the inside or an edge of the ballistic shell, power and/or data may be provided to an audio communications system that is fully integrated into the helmet and/or power and data may be provided through the circuit to modular ballistic elements that may be attached to the ballistic shell to extend the ballistic protection afforded by the helmet, preferably over substantially the entire face of the wearer of the helmet. It is preferable that power and data connections may additionally be provided on the outside surface of the ballistic shell for providing power and data through the circuit to one or more electrical devices that are mounted (preferably removably) on an outside surface of the ballistic shell.

Each of the non-limiting embodiments described herein provides a fully integrated ballistic helmet and hearing protection system, which includes sensors and transducers either built directly into the helmet shell or mountable thereon. In addition the invention has the capability of adding further ballistic protection elements, any of which can have additional sensors and transducers incorporated.

To distribute power and data communications around the invention a series of electrical conductors is used. The conductors can, as discussed, either be within the thickness of the ballistic shell, i.e. embedded in the ballistic shell, as discussed below with reference to FIGS. 8*a* and 8*b*, or inside the ballistic shell, as discussed below with reference to FIGS. 8*c* and 8*d*.

Helmets according to the present invention preferably use composite materials to provide protection against ballistic objects. They may also be formed from nano materials, metals, auxetic materials or ceramics, as will be readily appreciated by those skilled in the art.

The ballistic shell may, for example, comprise a moulded shell formed by laying up and moulding multiple plies of a fibre reinforced composite material on a generally helmet shaped pre-form of any desired shape. The fibre reinforced composite material may comprise aramid fibers, such as KEVLAR®, or other ballistic fibre impregnated with a polymer resin. Conductive circuit layers may be provided between composite material layers, as the ballistic shell is built up, to provide a conductive laminate construction. Such an arrangement is shown in FIG. 8*a*, which comprises fibre reinforced composite layers 7, 8, 9 and conductive circuit layers 2. It should be noted that whilst three composite layers and two circuit layers are shown, the present arrangement need not be limited as such, there may be more or less composite or conductive layers provided, as will be readily appreciated by those skilled in the art. The outer most layer will always be a composite (ballistic) layer, however. The circuit layers 2 may include a circuit substrate formed of a flexible material, such as a flexible film or tape, e.g. polyimide, polyester or other material, with a conductive pattern formed thereon that is comprised of one or more conductive pathways. The electrically conductive pattern may be formed, for example, via etching, depositing, printing (e.g., using a conductive ink containing carbon or other conductive filler), electro plating, or otherwise.

The ballistic shell may alternatively be formed by injection moulding an ultra high molecular weight polymer or similar, in which case, as shown in FIG. 8*b*, the circuit layers 2 may be encapsulated within the material forming the ballistic shell as the ballistic shell is moulded.

Figure 9A:
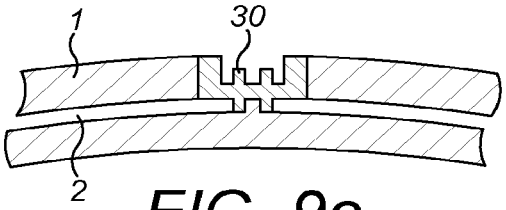
FIGS. 9*a* and 9*b* show exemplary arrangements for the provision of power/data connectors on the outside or inside surface of the ballistic shell.
Figure 9B:
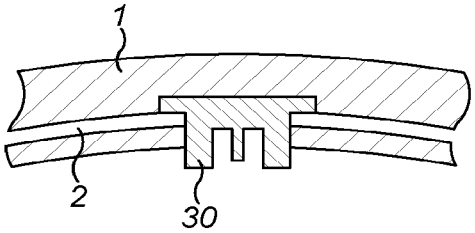

In any arrangement where the circuit layers are embedded within the thickness of the ballistic shell, electrical connections to the circuit can be made from an inside or outside surface of the ballistic shell by the provision of electrically conductive pins or other electrically conductive means inserted through the ballistics material to create an electrical connection with the circuit layers. FIG. 9*a* shows an example electrical connection made to the outside of the ballistic shell 1, which comprises electrically conductive pins 30, and FIG. 9*b* shows an example electrical connection made to the inside of the ballistic shell 1, which comprises electrically conductive pins 11. In the arrangements shown in FIGS. 9*a* and 9*b*, the ballistic shell 1 is a moulded composite with the circuit layer(s) embedded therein, it should be noted, however, that the connection means may be applied to any arrangement, including a laminate arrangement, where the circuit layer(s) are embedded in the ballistic shell. The connection means may also be applied to any additional (modular) ballistic protection elements (discussed below) that have circuit layer(s) embedded therein.

FIGS. 8*c* and 8*d* each show a cross-sectional view of a ballistic shell where the electrical conductors (circuit layers) are mounted onto the inside of the ballistic shell. The conductors 2 may be attached directly or indirectly to the inner surface of the ballistic shell. The conductors may comprise a circuit substrate provided with a conductive layer, as described above. Whatever form the conductors take, they are preferably covered with a non-conductive material layer on one or both of their faces or are embedded in a suitable non-conductive material. Connections can be made on the inside of the ballistic helmet through the non-conductive protection. Additionally, electrical connections may be provided on an outside of the helmet through the ballistic shell. Where the circuit layers are provided on an inside of the ballistic shell, the ballistic shell may be made from composite materials, such as those detailed in respect of the ballistic shells of FIGS. 8*a* and 8*b*, or otherwise, or may be formed from metal or any other suitable material.

A helmet comprising a ballistic shell in accordance with any of FIGS. 8*a* to 8*d* may preferably be fitted with a liner that provides impact protection as well as provides a comfortable fit for the user. The liner may be separate from the helmet or fitted to the helmet. In the arrangements of FIGS. 8*c* and 8*d* the circuit layers will preferably be provided between the liner and the ballistic shell.

Whatever construction, the helmet shell takes, the helmet is shaped to provide a large area of ballistic protection to the users. Different sizes of the helmet will be provided to allow the maximum ballistic protection for individual users.

Figure 10:
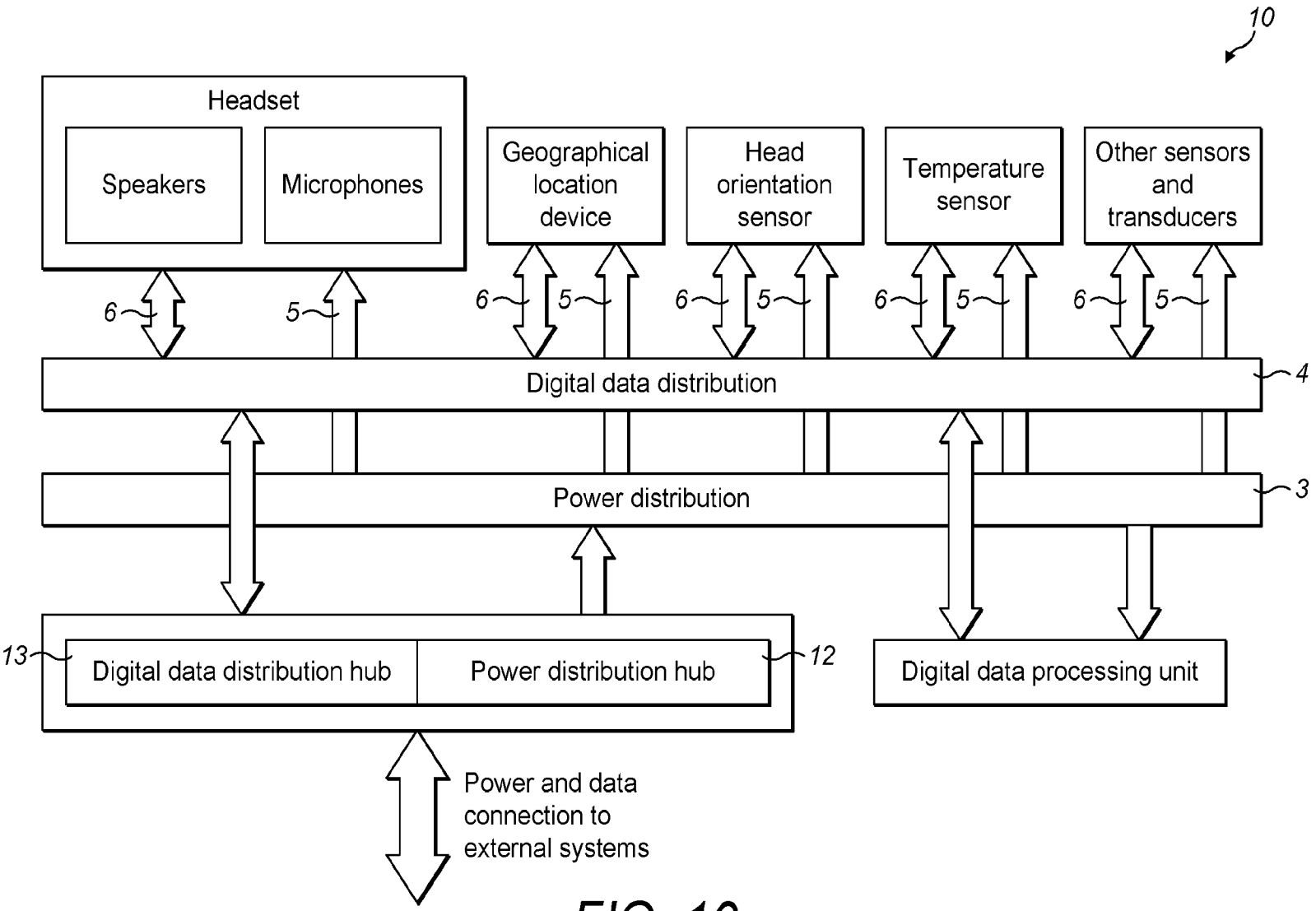
FIG. 10 shows a schematic representation of an exemplary circuit for power and data distribution for use in any of the arrangements shown in FIGS. 3 to 8.

An example of the architecture of the circuit for power and data distribution through the ballistic shell is shown in FIG. 10. As discussed further below, it is preferable that power and data enter the circuit (and thereby the ballistic shell), via a single connection point (11, FIG. 7). A power distribution hub 12 is integrated into the helmet for distributing power through the circuit to equipment, sensors and transducers connected thereto. A digital communications hub 13 may be integrated into the helmet, which allows equipment, sensors and transducers integrated into or mounted on the helmet to communicate with each other. Any communications with external equipment is also managed by the digital communications hub. Power for the digital communications hub is received via the power distribution hub.

The power and the data distribution hubs connect to the power and data buses 3, 4, which comprise conductive patterns extending across the helmet shell, as required. Power and data connections, which, as mentioned above, may extend to an inner surface or an edge of the ballistic shell or to an inner surface of the ballistic shell, connect to the power and data buses to provide power and data connections to an audio communications headset that is preferably provided integrally with the helmet and to the equipment, sensors and transducers, which may be integrated with the helmet or may be removably attached thereto.

Digital data processing can be integrated into the helmet, most preferably integrated into the ballistic shell itself, either at a central point or distributed throughout the helmet, such as in the earpieces or transducer/sensor points. However, the digital data processing may be provided on an inside of the helmet rather than being embedded. By the provision of integrated data processing means, the communications burden to and from the helmet is reduced. The integrated data processing means may comprise one or more microprocessors of suitable architecture. One or more microprocessors may be embedded in the ballistic shell or provided inside the ballistic shell.

Figure 7:
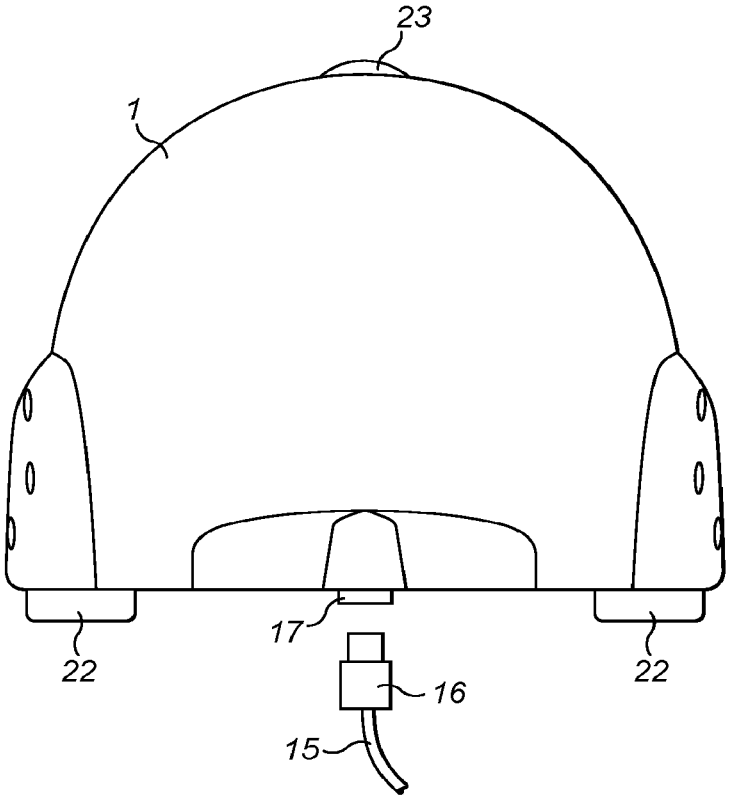
FIG. 7 shows a rear view of the ballistic helmet of FIG. 6.

With reference to FIG. 7, a single cable 15 is preferably used to connect to the power and distribution hub by means of a suitable connector 16, which plugs into a connection point 17 integrated into the rear of the ballistic shell at its base. The power distribution and digital communications hub are preferably also mounted at the rear of the ballistic shell at its base. As an alternative to the wired connection, there may be provided a wireless connection means, which may be located at the rear of the ballistic shell at its base, or otherwise. Moreover, any electronic devices connected to the circuit, including integrated earpieces, may take power from the circuit but may connect wirelessly to a control hub or similar that is integrated into the helmet or located remotely to the helmet.

With reference to FIGS. 3 to 6, various helmet configurations are now described, which may comprise a helmet shell and circuit layer configured in accordance with any of the above described arrangements. It should be noted that whilst various specific implementations are provided, these implementations are exemplary only. As will be readily appreciated by those skilled in the art, numerous variations will be possible within the scope of the claims that follow.

Users of ballistic helmets are commonly and regularly subjected medium or high levels of noise, which can cause Noise Induced Hearing Lose, (NIHL). It is preferable that helmets in accordance with the present invention are provided with hearing protection that is arranged to provide suitable hearing protection to prevent a user suffering hearing damage in a medium or high ambient noise environment.

A medium ambient noise environment is an environment where hearing damage or noise induced hearing loss can occur with long term exposure to the noise. The law of many countries attributes a continuous sound level of 85 dbA to this environment. Hearing damage or noise induced hearing loss can occur after an exposure period of 8 hour per day in such an environment. For impulse or impact noise the level is set at 140 db peak sound pressure level (SPL).

A high ambient noise environment is an environment where hearing damage or noise induced hearing loss can occur with short term exposure to the noise. The law of many countries attributes a continuous sound level of 105 dbSPL to this environment. Hearing damage or noise induced hearing loss can occur after an exposure period of 1 hour per day.

The above definitions of medium and high ambient noise environments are adopted herein.

Figure 1A:
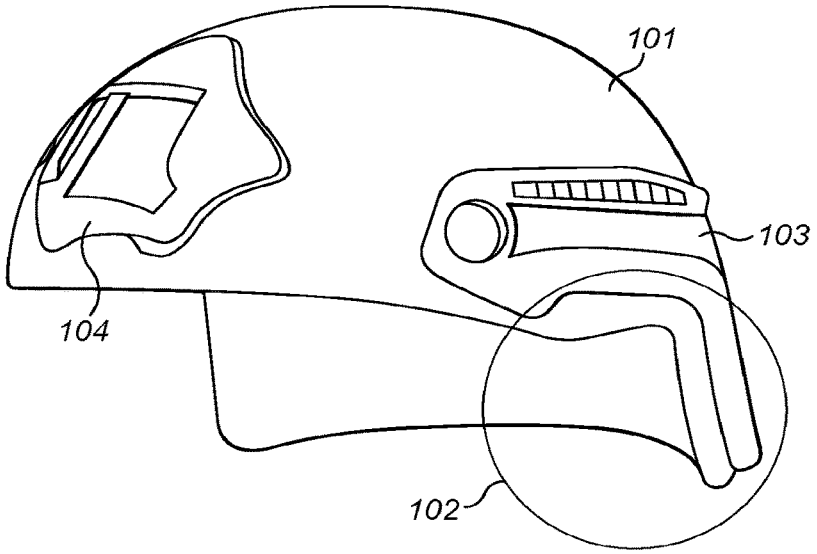
FIG. 1*a* shows a prior art ballistic helmet.
Figure 1B:
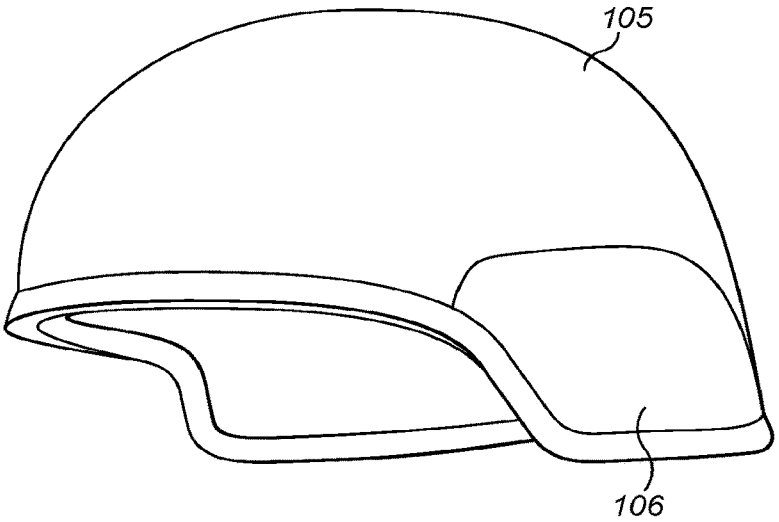
FIG. 1*b* shows an alternative prior art ballistic helmet.
Figure 2A:
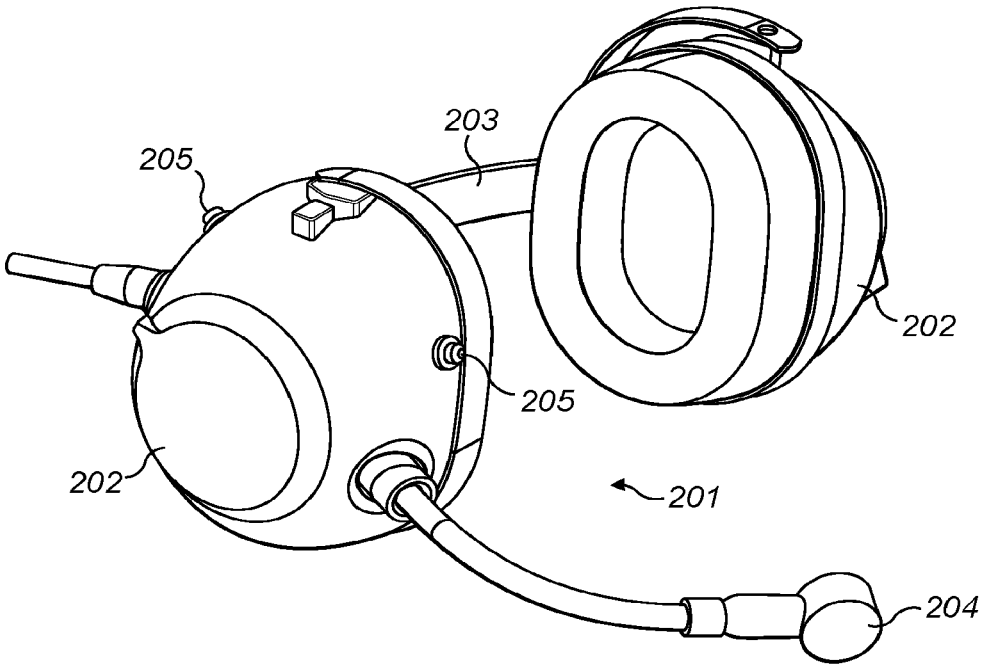
FIG. 2*a* shows a prior art hearing protection headset.
Figure 2B:
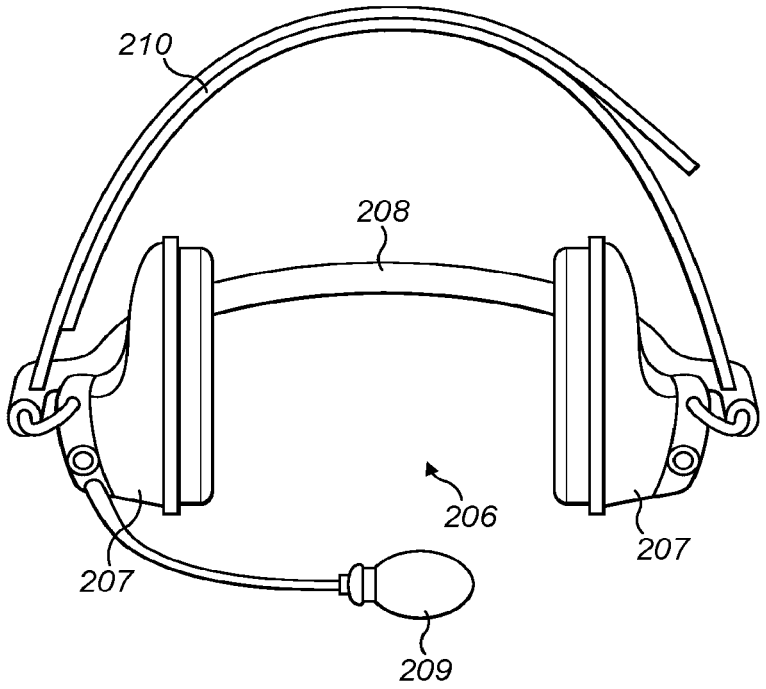
FIG. 2*b* shows an alternative prior art hearing protection headset.
Figure 3A:
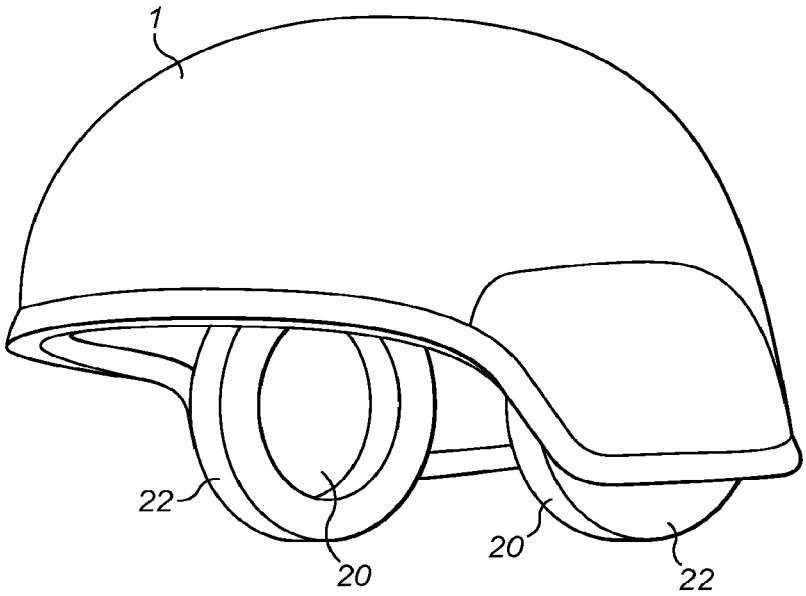
FIG. 3*a* shows a perspective view of a ballistic helmet according to a first embodiment of the present invention.
Figure 3B:
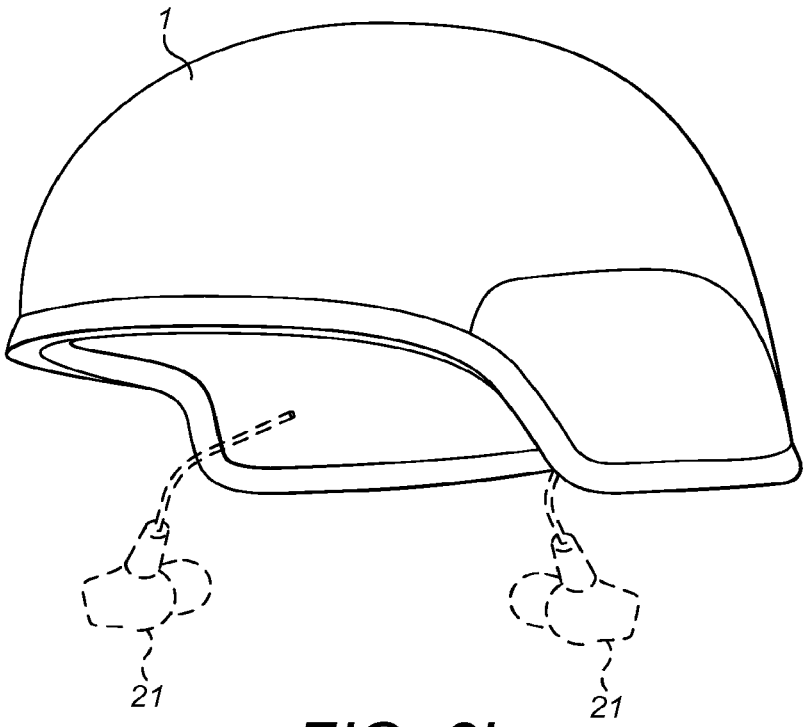
FIG. 3*b* shows a first modification to the ballistic helmet of FIG. 3*a;*

Hearing protection can be integrated into a ballistic helmet in accordance with the present invention, through the addition of circumaural earpieces 20 or in-the-ear earpieces 21 that are integrated into the helmet, as shown in FIGS. 3*a* and 3*b* respectively. The earpieces are designed to provide passive attenuation of the sounds and noises in the ambient environment that the user is subjected to. Various methods and designs of circumaural and in-the-ear earpieces are can be used, as will be appreciated by those skilled in the art.

A suitable circumaural hearing protection earpiece may comprise a compliant ear pad 22 that conforms to the side of the user's head. The ear pad may, for example, be constructed from foam or silicon, or any other compliant material that is capable of provided passive noise attenuation. A circumaural ear pad is arranged to fit entirely over the pinna of a wearer. A unique aspect of the present invention is the integration of such earpieces into the helmet in accordance with the present invention. A mounting for the ear pad is provided, allowing new or different ear pads to be fitted as required. The ear pads 22 are preferably attached to an inner face of the ballistic shell, as shown in FIG. 3*a*, such that circumaural earpieces are formed which comprise the ballistic shell and the ear pads, which circumaural earpieces provide passive sound attenuation for the wearer of the ballistic helmet that is sufficient to protect the wearer's hearing in a medium or high noise environment. The ear pads may, however, be mounted to an intermediate element, which may be fixed or removable.

In-the-ear hearing protection earpieces typically consist of earbud that is inserted into the ear canal of the user. The earbuds can be constructed from foam or silicon, or any other compliant material that is capable of being inserted into an ear canal and of providing passive noise attenuation. Several forms of construction and design can be used to the earbuds that include but are not limited to rebound foam, single or multiple flange silicon or custom moulded silicon earbuds. In-the-ear earpieces 21 are shown in FIG. 3*b*. A mounting method is provided that attaches the earbud to the helmet shell and allows the earbud to be inserted into the ear canal. The earbud mounting will preferably be attached to the helmet by a suitable method, such as, but not limited to, a lanyard.

Irrespective of whether circumaural or in-the-ear earpieces are provided integrated to the helmet, there will be suitable data and/or power connections provided adjacent to each of the earpieces, on an inside of the ballistic shell, for connecting the earpieces to the circuit 10. For in-the-ear earpieces a suitable mechanical plug may be provided that allows for connection and disconnection of the earpieces. It should also be noted that both circumaural ear pads, attached in any manner detailed above, may be provided in conjunction with in-the-ear earpieces, wherein the provision of both circumaural ear pads and in-the-ear earpieces may provide for enhanced hearing protection.

It should be noted that when, in accordance with the embodiments of the present invention, there is no requirement to fit a separate circumaural headset under the helmet, the ballistic protection may be extended, without significantly increasing the bulk of the helmet. It is particularly preferred that the ballistic shell substantially or entirely covers the ears of a wearer. It is preferable that the ballistic shell in portions that cover the wearer's ears is arranged to extend to a level below the bottom of a wearer's pinna. As mentioned a range of differently sized helmets will be provided so that a suitable fit can be achieved for each user.

When wearing a hearing protection headset the noise in the ambient noise environment is reduced such that the user may not be able to hear sounds in the immediate environment that form part of the users situational awareness. To counteract this issue "situational awareness" or "talk-through" functionality may be added to a helmet according to the present invention by adding a speaker to the earpiece, a microphone 23 that samples the ambient environment and a circuit that couples the speaker and microphone. All of the required electronics are preferably integrated into the helmet, most preferably embedded into the ballistic shell or provided on the inside of the ballistic shell, and are connected to the power and data buses 3, 4 of the circuit 10.

The circuit 10 receives an electrical signal from the microphone 23 that represents the sounds in the ambient environment and passes the signal to the speaker. The user then hears the sounds present in the ambient environment. The circuit can limit the signal sent to the speaker ensuring that the users' hearing is still protected. The circuit can be enhanced by correcting to the frequency response of the microphone and speaker therefore providing a truer representation of the ambient sound environment.

The speaker needs to be incorporated within the circumaural and in-the-ear earpiece such that the sounds reproduced are passed directly to the users ear drum.

Most preferably, two or more microphones, or two or more sets of microphones, will be used to sample the ambient environment, with each microphone or set of microphones positioned in the vicinity of the earpiece. A single microphone could be used but the quality of the situational awareness or talk-through functionality will be reduced. The microphones are preferably embedded in the ballistic shell. Suitable openings may be provided in the ballistic shell so that the microphones may suitably sample the ambient environment.

FIGS. 4 to 7 show the inclusion of situational awareness or talk-through functionality into helmets with integrated circumaural hearing protection. It should be noted that such functionality may equally be incorporated into helmets in accordance with the present invention that feature integrated in-the-ear earpieces, such as those shown in FIG. 3*b*.

Figure 4:
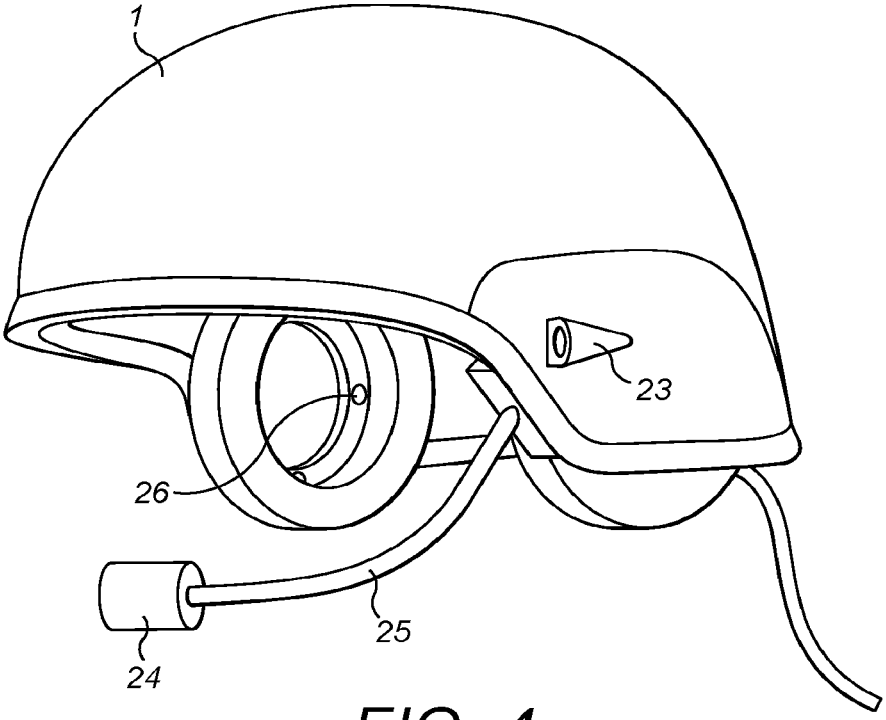
FIG. 4 shows a second modification to the ballistic helmet of FIG. 3*a;*
Figure 5:
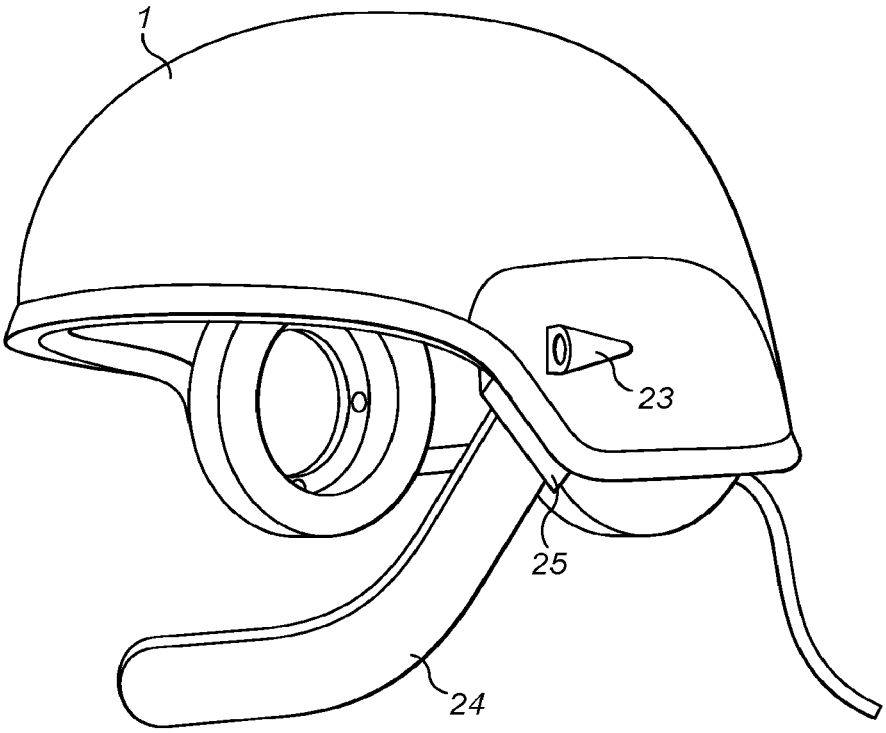
FIG. 5 shows a third modification to the ballistic helmet of FIG. 3*a;*

The users of a ballistic helmet with integrated hearing protection need to be able to communicate with other people. The communication, to be useful, is two way, with an individual being able to receive voice communications from other users through the earpieces and being able to transmit their voice to other users. By adding a voice sampling transducer 24 to the helmet according to the present invention, the user is able to connect to a communication device, thereby sending and receiving voice communications. The voice of the user can be sampled by the use of a transducer on a boom arm 25, which may be flexible, as shown in FIG. 4 or rigid as shown in FIG. 5, by an ear canal sampling transducer 26, by a bone conduction transducer or by other means of voice sampling. Furthermore, where additional ballistic protection elements are introduced, as discussed below, voice sampling transducers may be integrated therein and connected to the circuit 10 in the helmet.

The transducer boom arms 24, as shown in FIGS. 4 and 5, may be attached to the helmet either by a fixed means or by means of a mechanism that allows them to be detached. By using a mechanical means of attachment/detachment the boom arms may be mounted either on the left or right of the invention.

To further protect the user from the ambient noise field, active noise reduction may be added to the helmet according to the present invention. The active noise reduction can be feedback, feed forward, adaptive or hybrid. All necessary components for the active noise reduction may be embedded in the ballistic shell.

Figure 6:
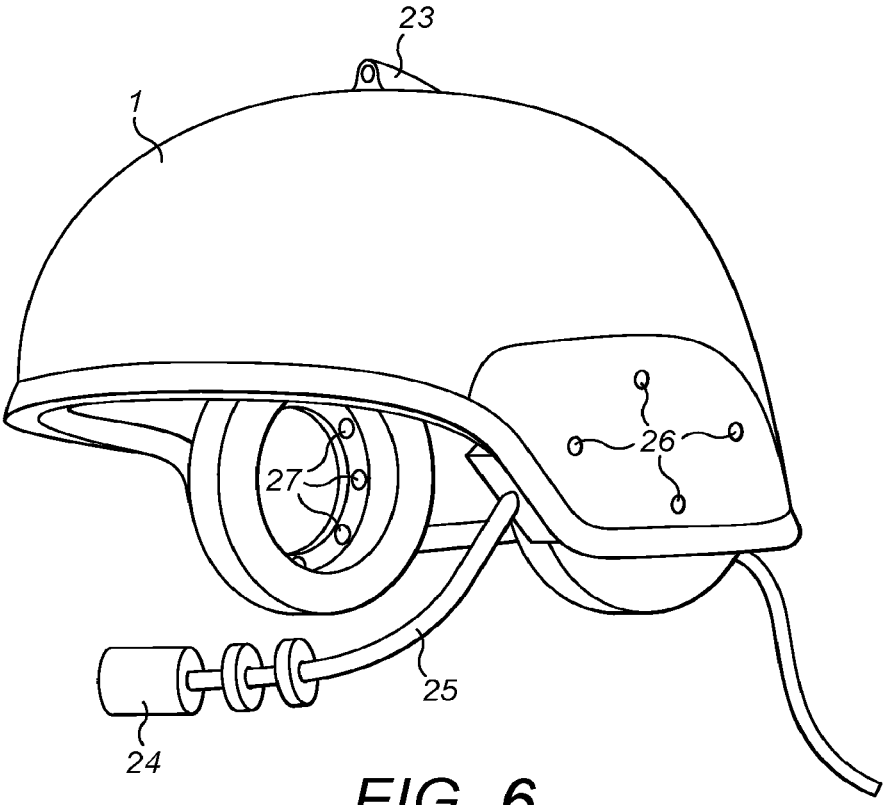
FIG. 6 shows a fourth modification to the ballistic helmet of FIG. 3*a;*

By virtue of the circuit integrated into the ballistic shell numerous additional sensors and transducers may be integrated into the helmet according to the present invention. For example, as shown in FIG. 6 a ring of transducers 26 can be used to sample the ambient environment. Similarly, a ring of transducers 27 can be used to sample the ear canal of the wearer. As mentioned, all sensors/transducers will preferably be provided within the thickness of the ballistic shell, most preferably embedded within the ballistic shell. Where necessary, one or more small holes may be provided to expose the sensor(s)/transducer(s) to the ambient environment.

Additional transducers can be mounted at different points on the invention, such as, but not limited to, a microphone mounted on top of the invention or on the boom arm.

Additional sensors that can be mounted onto the ballistic helmet, by embedding in the ballistic shell or otherwise, include, but are not limited to, head orientation sensors, geographical locations sensors, temperature sensors, biometric sensors, inclinometers, etc.

It is preferable that the helmet in accordance with the present invention is provided with one or more mechanical connection points for the removable attachment of one or more additional (modular) ballistic protection elements. These mechanical connection points may be on the edge of the ballistic shell, facing outwardly from the edge or rim of the ballistic shell. Power and data connections may also be provided on the edge of the ballistic shell to provide power and data to the additional ballistic protection elements from the circuit of the ballistic shell. Such additional ballistic protection elements may comprise, for example, eye protection, a gas mask, a chin protection element, or a full face protection element. An eye protection visor is shown is FIG. 11*a*, an ear protection element is shown in FIG. 11*b*, a mandible protection element is shown in FIG. 11*c* and a full face protection element is shown in FIG. 11*d*. Each element is arranged to extend the ballistic protection that is provided by the ballistic helmet. Moreover, increased tactical abilities may be provided by the attachment of sensors, transducers or other electrical equipment to these elements. Multiple additional ballistic protection elements may be used in combination with one another by attachment to the ballistic shell at the same time. The additional ballistic protection elements preferably each comprise a co-operating mechanical connection point(s) for engaging appropriate mechanical connection point(s) on the helmet.

The additional ballistic protection elements preferably each comprise a ballistic layer, one or more circuit layers, which form a circuit comprising a power bus and a data bus, and one or more power connections and one or more data connections, wherein the power and data connections of the circuit of the additional ballistic protection elements are arranged to engage corresponding power and data connections to sensors, transducers or other electrical devices provided on the additional ballistic protection elements through the circuit 10 of the helmet.

The additional ballistic protection elements may be constructed in accordance with any described construction of the ballistic shell provided herein. Any of the additional ballistic protection elements may have sensors, transducers or processors embedded therein, in dependence of the functionality provided by the additional ballistic protection element.

The one or more circuit layers of the additional ballistic protection element are preferably provided within the thickness of the ballistic layer or an inner surface of the ballistic layer, and may be formed in accordance with the circuit layers in the ballistic shell as described above.

Figure 11A:
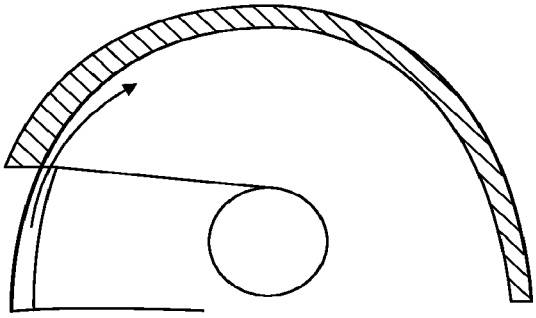
Figure 11B:
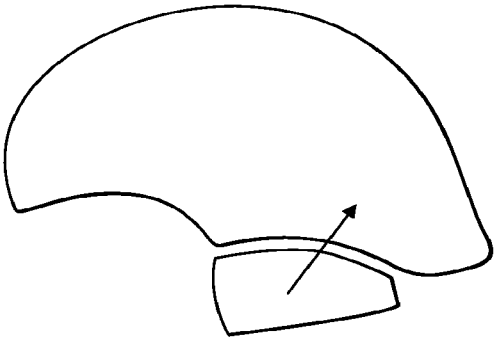
Figure 11C:
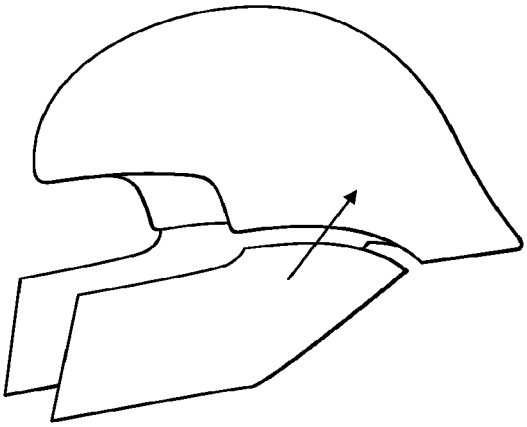
Figure 11D:
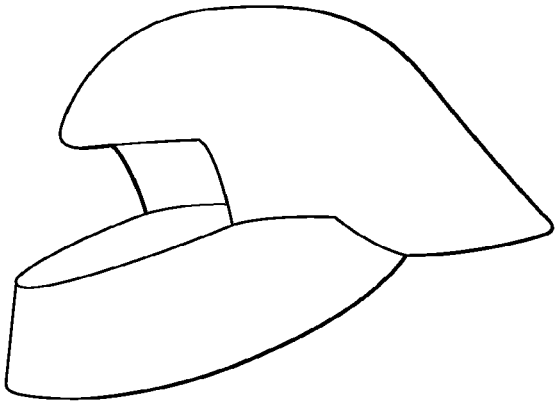

The eye protection visor, as shown in FIG. 11*a*, is preferably pivotally mounted to the helmet. It may alternatively be mounted in accordance with any of the remaining additional ballistic protection elements using co-operating mechanical connection point(s) for engaging appropriate mechanical connection point(s) on the ballistic shell, which will allow for detachment of the visor. The visor is preferably formed from a transparent material that provides ballistic protection. The visor is preferably arranged either to retract into the thickness of the ballistics shell by the provision of an opening in the ballistic shell for receiving all or a portion of the visor when it is pivoted or to retract partially or fully inside the helmet. The latter arrangement is shown in FIG. 11*a*.

Any of the equipment, sensors or transducers provided on/embedded in the ballistic shell or any of the additional ballistic protection elements can preferably communicate with each other or the digital data processing unit via the digital data distribution hub 13 of the circuit 10.

Both the ballistic shell and any of the additional ballistic protection elements may be provided with suitable mechanical connectors on their outer surfaces for the attachment of electronic devices, including but not limited to, cameras, heads up displays, and vision systems (with or without ballistic protection), which electronic devices will be connected to power and/or data connections of the circuit. Picatinny rails may be provided for the attachment of such devices, which Picatinny rails are suitably connected to the circuit layers.

Numerous alternatives and modifications within the scope of the appended claims are possible, as will be readily appreciated by those skilled in the art.

The invention claimed is:

1. A ballistic helmet comprising a ballistic shell having an exterior surface and an opposing interior surface; a liner connected to the interior surface of the ballistic shell and configured to provide impact protection to a head of a user wearing the ballistic helmet; and a circuit layer assembly embedded within a thickness of the ballistic shell between the exterior and interior surfaces, wherein the circuit layer assembly is between the liner and the exterior surface of the ballistic shell, and the circuit layer assembly has one or more circuit layers forming a circuit comprising a power bus and a data bus, and wherein one or more power connections and/or one or more data connections are connected to the circuit and provided interior of and/or on an edge of the ballistic shell for providing power and data to/from one or more electrical devices through the circuit, wherein the ballistic helmet comprises integrated earpieces for the provision of an audio signal to the wearer of the helmet, and wherein at least one of the data connections and/or at least one of the power connections is provided adjacent each earpiece, thereby providing data and/or power connections for the earpieces to the circuit, wherein the power and data buses comprise conductive patterns formed in the ballistic shell of the ballistic helmet.

2. A ballistic helmet as claimed in claim 1, wherein there is further provided one or more power connections and/or one or more data connections on the exterior surface of the ballistic shell for providing power and data to/from one or more electrical devices through the circuit.

3. A ballistic helmet as claimed in claim 2, wherein the power and data connections provided on the interior of the ballistic shell and the power and data connections provided on the exterior surface of the ballistic shell are offset from one another.

4. A ballistic helmet as claimed in claim 1, wherein the ballistic shell is arranged to substantially or entirely cover the ears of a wearer during use.

5. A ballistic helmet as claimed in claim 1, wherein the ballistic shell on opposed sides comprises portions that cover the user's ears in use, and each portion is arranged to extend to a level below the wearer's pinna.

6. A ballistic helmet as claimed in claim 1, wherein, through the circuit, a wired power connection is provided for each earpiece, and the earpieces comprise wireless data communication means.

7. A ballistic helmet as claimed in claim 1, wherein the earpieces are provided with active noise cancelling means, and components of the active noise cancelling means are embedded within the ballistic shell or provided inside the ballistic shell.

8. A ballistic helmet as claimed in claim 7, wherein a noise cancelling circuit and one or more microphones are embedded within the ballistic shell or provided inside the ballistic shell and are connected to the circuit.

9. A ballistic helmet as claimed in claim 8, wherein the noise cancelling circuit is a feedback, feed forward, adaptive or hybrid noise cancelling circuit.

10. A ballistic helmet as claimed in claim 1 further comprising integrated ear pads, which are attached to an inner face of the ballistic shell, the ear pads being arranged such that circumaural earpieces are formed which comprise the ballistic shell and the ear pads.

11. A ballistic helmet as claimed in claim 10, wherein the circumaural earpieces provide passive sound attenuation for the wearer of the ballistic helmet that is sufficient to protect the wearer's hearing in a medium or high noise environment.

12. A ballistic helmet as claimed in claim 1 further comprising one or more microphones embedded in the ballistic shell and arranged to sample the ambient environment, the one or more microphones are connected to the circuit and processing means are provided for passing an audio signal from the one or more microphones to speakers provided in the earpieces.

13. A ballistic helmet as claimed in claim 1, wherein the ballistic helmet comprises one or more integrated microphones or transducers arranged to receive the voice of the wearer of the helmet, wherein the microphones or transducers are connected to the data bus of the circuit.

14. A ballistic helmet as claimed in claim 13, wherein the integrated microphones and transducers are embedded within the ballistic shell.

15. A ballistic helmet as claimed in claim 1, wherein a single power and data connection point is provided for providing a power and data connection between the circuit and equipment external to the ballistic helmet.

16. A ballistic helmet as claimed in claim 15, wherein the single power and data connection point is provided at the base of the helmet at its rear.

17. A ballistic helmet as claimed in claim 1, wherein a wireless power and/or data connection means is provided for the provision of a wireless power and/or data connection to the circuit.

18. A ballistic helmet as claimed in claim 1, further comprising one or more mechanical connection points for the attachment of one or more additional ballistic protection elements, wherein each additional ballistic protection element comprises a ballistic layer, one or more circuit layers, which form a circuit comprising a power bus and/or a data bus, and one or more power connections and/or one or more data connections that are arranged to engage corresponding power and data connections on the ballistic shell.

19. A ballistic helmet as claimed in claim 18, wherein the one or more circuit layers of the additional ballistic protection element are provided within the thickness of the ballistic layer of the additional ballistic protection element or an inner surface of the ballistic layer of the additional ballistic protection element.

20. A ballistic helmet as claimed in claim 18, wherein the one or more additional ballistic protection elements comprises eye protection, a gas mask, ear protection elements, mandible protection elements, a chin protection element, and/or a full face protection element.

* * * * *